US012240021B2

(12) United States Patent
Brown et al.

(10) Patent No.: US 12,240,021 B2
(45) Date of Patent: Mar. 4, 2025

(54) SENSING AND OFFSETTING THE FORCE OF EVENTS IN A COIL FORMING OPERATION

(71) Applicant: Novelis Inc., Atlanta, GA (US)

(72) Inventors: Rodger Eugene Brown, Atlanta, GA (US); Timothy Francis Stanistreet, Acworth, GA (US)

(73) Assignee: Novelis Inc., Atlanta, GA (US)

( * ) Notice: Subject to any disclaimer, the term of this patent is extended or adjusted under 35 U.S.C. 154(b) by 146 days.

(21) Appl. No.: 17/759,127

(22) PCT Filed: Dec. 11, 2020

(86) PCT No.: PCT/US2020/064533
§ 371 (c)(1),
(2) Date: Jul. 20, 2022

(87) PCT Pub. No.: WO2021/150315
PCT Pub. Date: Jul. 29, 2021

(65) Prior Publication Data

US 2023/0040831 A1 Feb. 9, 2023

Related U.S. Application Data

(60) Provisional application No. 62/964,200, filed on Jan. 22, 2020.

(51) Int. Cl.
*B65H 18/26* (2006.01)
*B21B 1/16* (2006.01)
*B21B 37/00* (2006.01)

(52) U.S. Cl.
CPC ..... *B21B 1/16* (2013.01); *B21B 37/00* (2013.01); *B65H 18/26* (2013.01)

(58) Field of Classification Search
CPC ..... B65H 18/26; B21B 1/16; B21C 47/063
See application file for complete search history.

(56) References Cited

U.S. PATENT DOCUMENTS 3,837,593 A * 9/1974 Dorfel ..... B65H 18/20 242/534
4,380,164 A * 4/1983 Kuwano ..... B65H 19/28 242/534

(Continued)

FOREIGN PATENT DOCUMENTS

CN 1333710 A 1/2002
CN 101516539 A 8/2009

(Continued)

OTHER PUBLICATIONS

International Application No. PCT/US2020/064533 , International Search Report and Written Opinion, Mailed on Mar. 22, 2021, 12 pages.

(Continued)

*Primary Examiner* — Sang K Kim
(74) *Attorney, Agent, or Firm* — Kilpatrick Townsend & Stockton LLP

(57) ABSTRACT

Systems and methods directed to rolling mill coilers are disclosed. Systems and methods are disclosed for a control scheme to maintain a constant force between a roll and a coil's surface. Example systems and methods may include forming a portion of a coil, capturing a first coil data corresponding to force of the coil while the strip of metal is being rolled into the coil, capturing second coil data corresponding to position of the coil while the strip of metal is being rolled into the coil, determining a signal that corresponds to a roll force of the roll and a position of the protrusion, and transmitting the signal to a hydraulic cylinder coupled to the roll, the hydraulic cylinder causing the (Continued)

roll to exert the roll force counter to the radial force of the coil.

16 Claims, 9 Drawing Sheets

(56) References Cited

U.S. PATENT DOCUMENTS

| | | | | |
|---|---|---|---|---|
| 5,320,299 | A * | 6/1994 | Fitzpatrick | B65H 18/26 242/541.6 |
| 6,648,264 | B1 * | 11/2003 | Kukizaki | B21C 47/326 242/422.5 |
| 9,662,697 | B2 * | 5/2017 | Tachibana | B21C 47/04 |
| 2003/0033844 | A1 | 2/2003 | O'fathaigh | |
| 2009/0101745 | A1 * | 4/2009 | St. Germain | B65H 23/1888 242/417.3 |

FOREIGN PATENT DOCUMENTS

| | | | |
|---|---|---|---|
| CN | 201586675 | U | 9/2010 |
| CN | 104815869 | A | 8/2015 |
| EP | 0963932 | A2 | 12/1999 |
| EP | 1132155 | | 9/2001 |
| EP | 1132155 | B1 | 11/2004 |
| GB | 2136776 | A | 9/1984 |
| JP | 01131994 | U | 9/1989 |
| JP | 05277555 | A | 10/1993 |
| JP | H08-24945 | A | 1/1996 |
| JP | H08-141638 | A | 6/1996 |
| JP | H08-192223 | A | 7/1996 |
| JP | H08-197135 | A | 8/1996 |
| JP | H08-206732 | A | 8/1996 |
| JP | 11123454 | A | 5/1999 |
| JP | H11-277134 | A | 10/1999 |
| JP | 11319941 | A | 11/1999 |
| JP | 2002-219514 | A | 8/2002 |
| JP | 2008-264878 | A | 11/2008 |
| KR | 20010107974 | A | 12/2001 |
| KR | 20120136845 | A | 12/2012 |

OTHER PUBLICATIONS

Japanese Application No. 2022-544335, "Office Action", Mailed on Jul. 25, 2023, 16 pages.
CA Application No. 3,168,206, "Office Action", mailed on Oct. 12, 2023, 4 pages.
EP Application No. 20848735.5, "Office Action", mailed on Jun. 23, 2023, 6 pages.
JP Application No. 2022-544335, "Notice of Decision to Grant", mailed on Nov. 28, 2023, 5 pages.
CN Application No. 202080098895.0 , "Office Action", Jul. 15, 2024, 12 pages.
EP Application No. 20848735.5 , "Office Action", Dec. 15, 2023, 4 pages.
KR Application No. 10-2022-7026867, "Office Action", Sep. 19, 2024, 18 pages.
CA Application No. 3,168,206 , "Office Action", Oct. 25, 2024, 4 pages.
CN Application No. 202080098895.0 , "Office Action", Dec. 25, 2024, 18 pages.

* cited by examiner

SENSING AND OFFSETTING THE FORCE OF EVENTS IN A COIL FORMING OPERATION

CROSS-REFERENCE TO RELATED APPLICATION

This application claims the benefit of and priority to U.S. Provisional Application No. 62/964,200, filed Jan. 22, 2020, and titled "SENSING AND OFFSETTING THE FORCE OF EVENTS IN A COIL FORMING OPERATION," the content of which is incorporated herein by reference in its entirety for all purposes.

FIELD OF THE INVENTION

This application relates to rolling mill toilers. More specifically, systems and methods are disclosed for a control scheme to maintain a constant force between a roll and a coil's surface.

BACKGROUND

A metal ingot can be rolled into a strip of metal during a rolling operation. The strip of metal may be rolled into a coil using a rolling mill toiler. When a metal strip is rolled into a coil, air may get trapped between laps of the coil. Air entrapment may cause certain problems, such as a scratch-gouge defect and coil scoping, among others. Rolling mill coders may incorporate a roll, which may contact a surface of the coil, into the rolling mill to limit air entrapment between laps of a coil. A bump or protrusion in the coil may cause a radial force of the coil and the roll, which may prevent a constant force between the coil and the roll during rolling of the coil.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

An example embodiment of the present technology may include a method. The method may comprise, for example, forming, by a coil forming operation using a coiling apparatus, a portion of a coil including a first lap of coil and a second lap of coil from a strip of metal, wherein the second lap of coil includes a protrusion; capturing, by a first sensor during the coil forming operation, first coil data associated with the coil while the strip of metal is being rolled into the coil, wherein the first coil data includes data corresponding to a radial force from the coil applied to an roll when the roll contacts the protrusion; capturing, by a second sensor during the coil forming operation, second coil data associated with the coil while the strip of metal is being rolled into the coil, wherein the second coil data includes data corresponding to a position of the coil when the roll contacts the coil; determining, using the first coil data, the second coil data, and a circuit, a signal that corresponds to a roll force of the roll and a position of the protrusion; and transmitting, to a hydraulic cylinder coupled to the roll, the signal, wherein after the signal is received by the hydraulic cylinder, the hydraulic cylinder causes the roll to exert the roll force, wherein the roll force is counter to the radial force of the coil.

In additional aspects, the hydraulic cylinder causing the roll to exert the roll force includes reducing the force exerted by the roll. The method may further include determining, using a reel encoder electrically, or angular encoder mechanically, connected to the coil, data corresponding to frequencies of the coil over a period of time. In additional aspects, the circuit includes a set of self-tuning bandpass filters. In additional aspects, each filter of the set of self-tuning bandpass filters is associated with a harmonic of an angular speed of the coil. In additional aspects, the protrusion in the second lap of the coil is formed at least in part by a leading edge of the first lap of coil. In additional aspects, the second coil data includes data corresponding to a position of the coil when the roll contacts the protrusion. In additional aspects, the first sensor is a force load cell electrically connected to the roll. In additional aspects, the second sensor is a linear transducer electrically connected to the hydraulic cylinder. In additional aspects, the roll is an ironing roll.

Another example embodiment may include a system. The system may comprise, for example, a roll configured to contact a surface of a coil, wherein the coil is formed by a coil forming operation using a coiling apparatus; a force load cell configured to capture first data corresponding to a first force delivered by the coil in a first direction; a linear transducer configured to capture second data corresponding to a position of the coil; a circuit configured to determine, using the first data and the second data, a signal associated with a second force to counteract the first force, and a hydraulic cylinder configured to receive the signal from the circuit and deliver the second force to the roll in a second direction opposite the first direction.

In additional aspects, the hydraulic cylinder causing the roll to exert the roll force is configured to reduce the force exerted by the roll. In additional aspects, the system further comprises a reel encoder electrically, or angular encoder mechanically, connected to the coil, wherein the reel encoder is configured to generate data corresponding to frequencies of the coil over a period of time. In additional aspects, the circuit includes a set of self-tuning bandpass filters. In additional aspects, each filter of the set of self-tuning bandpass filters is associated with a harmonic of an angular speed of the coil. In additional aspects, a portion of the coil includes a first lap of coil and a second lap of coil from a strip of metal, wherein the second lap of coil includes a protrusion, wherein the protrusion in the second lap of the coil is formed at least in part by a leading edge of the first lap of coil. In additional aspects, the second coil data includes data corresponding to a position of the coil when the roll contacts the protrusion. In additional aspects, the roll is an ironing roll.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

A further understanding of the nature and advantages of various embodiments may be realized by reference to the following figures. The features and components of the figures are illustrated to emphasize the general principles of the present disclosure. In the appended figures, similar components or features may have the same reference label. Further, various components of the same type may be distinguished by following the reference label with a dash and a second label that distinguishes among the similar components. If only the first reference label is used in the specification, the description is applicable to any one of the similar components having the same first reference label irrespective of the second reference label.

DETAILED DESCRIPTION

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

This application relates to rolling mill coders. More specifically, systems and methods are disclosed for a control scheme to maintain a constant force between a roll and a coil's surface. The roll may move in an arc motion to follow the nip as the coil size increases over time.

A metal ingot can be rolled into a strip of metal during a rolling operation. The strip of metal may be rolled into a coil using a coiler and a coiling operation. When a metal strip is rolled into a coil, air may get trapped between laps of the coil. Air entrapment may cause certain problems, such as the scratch-gouge defect and coil sculpting, among others. Rolling mill toilers may incorporate a roll, which may contact a surface of the coil, into the rolling mill to limit air entrapment between laps of a coil. A bump or protrusion in the coil may cause a radial force of the coil and the roll, which may prevent a constant force between the coil and the roll during rolling of the coil. The terms "bump" and "protrusion" may be used interchangeably herein.

More specifically, even if small due to the thin nature of a rolled metal strip, the metal strip has a width, and therefore the leading edge of the metal strip has a non-zero height. When the metal strip begins coiling on the coiler, the leading edge of the metal strip may begin the first lap of the coil. When the second lap of the coil begins, the second lap of the metal strip will lay on top of the leading edge of the metal strip, causing a protrusion. The protrusion may be caused by the width of the leading edge of the coil and the distance between the outer surface of the first lap of the coil and the coiler drum. The roll may contact the surface of the coil at a nip of the coil (the "nip" of the coil may be a location where two rolls, such as the coil and the incoming metal strip, come into contact). When the protrusion caused by the first lap of coil and the nip are at the same location around the circumference of the coil, the protrusion may cause an extra radial force from the coil to the roll. This extra force may cause the force between the roll and the coil to become inconsistent. A control scheme may use eccentricity compensation to maintain a constant force between the roll and coil surface throughout the process, even when such a protrusion in the coil exists.

Figure 1:
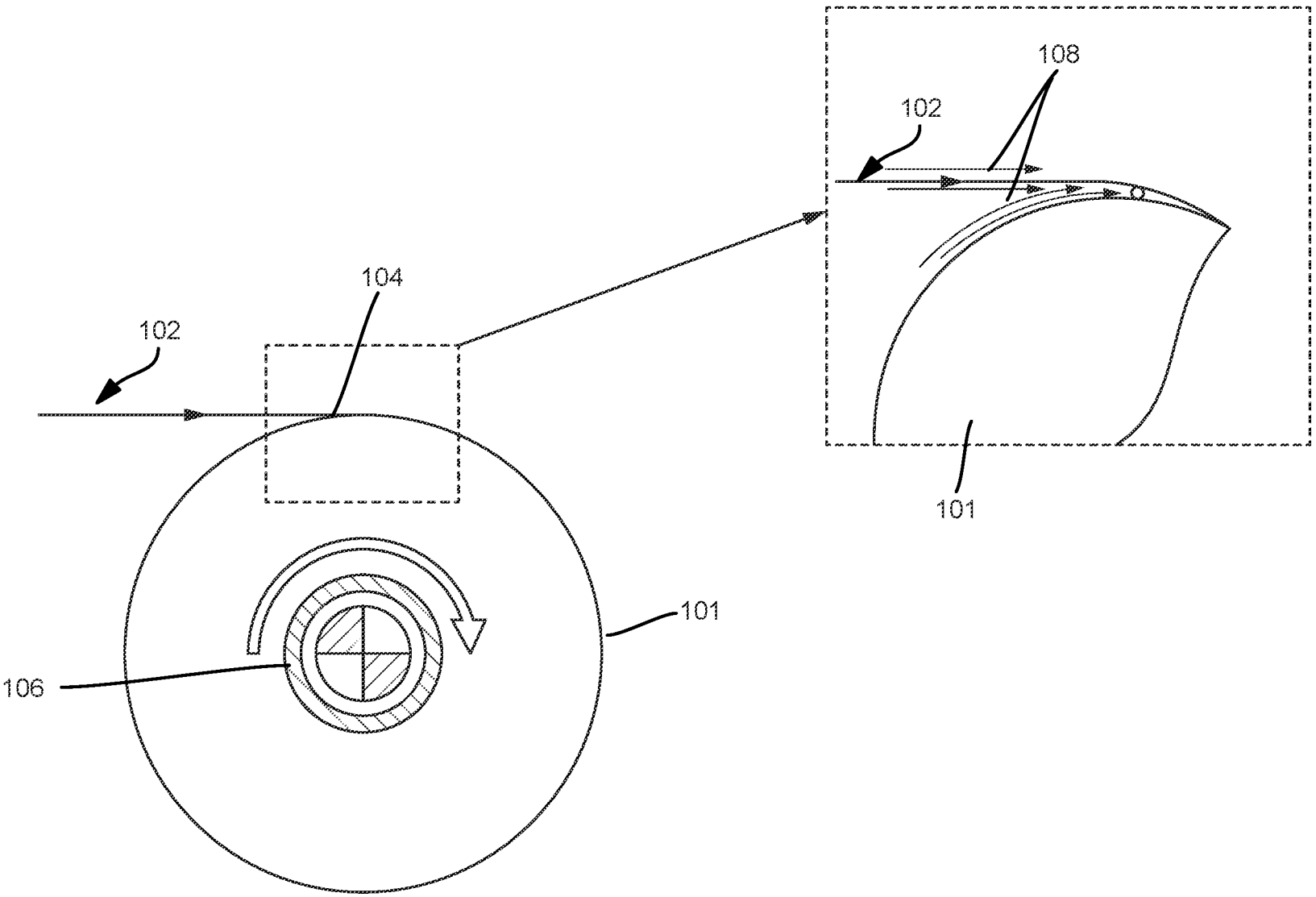
FIG. 1 illustrates a coil formed from a strip of metal with air entrapment in the coil.

FIG. 1 illustrates a coil formed from a strip of metal with air entrapment in the coil. A strip of metal 102 may be fed onto a coiling drum 106. After multiple laps of the strip of metal 102 have been layered on top of one another around the coiling drum 106, the strips of metal make up a coil 101. As the coiling drum 106 (and the coil 101) rotate, more portions of the strip of metal 102 will layer onto the coil and cause the diameter of the coil to increase.

Figure 2:
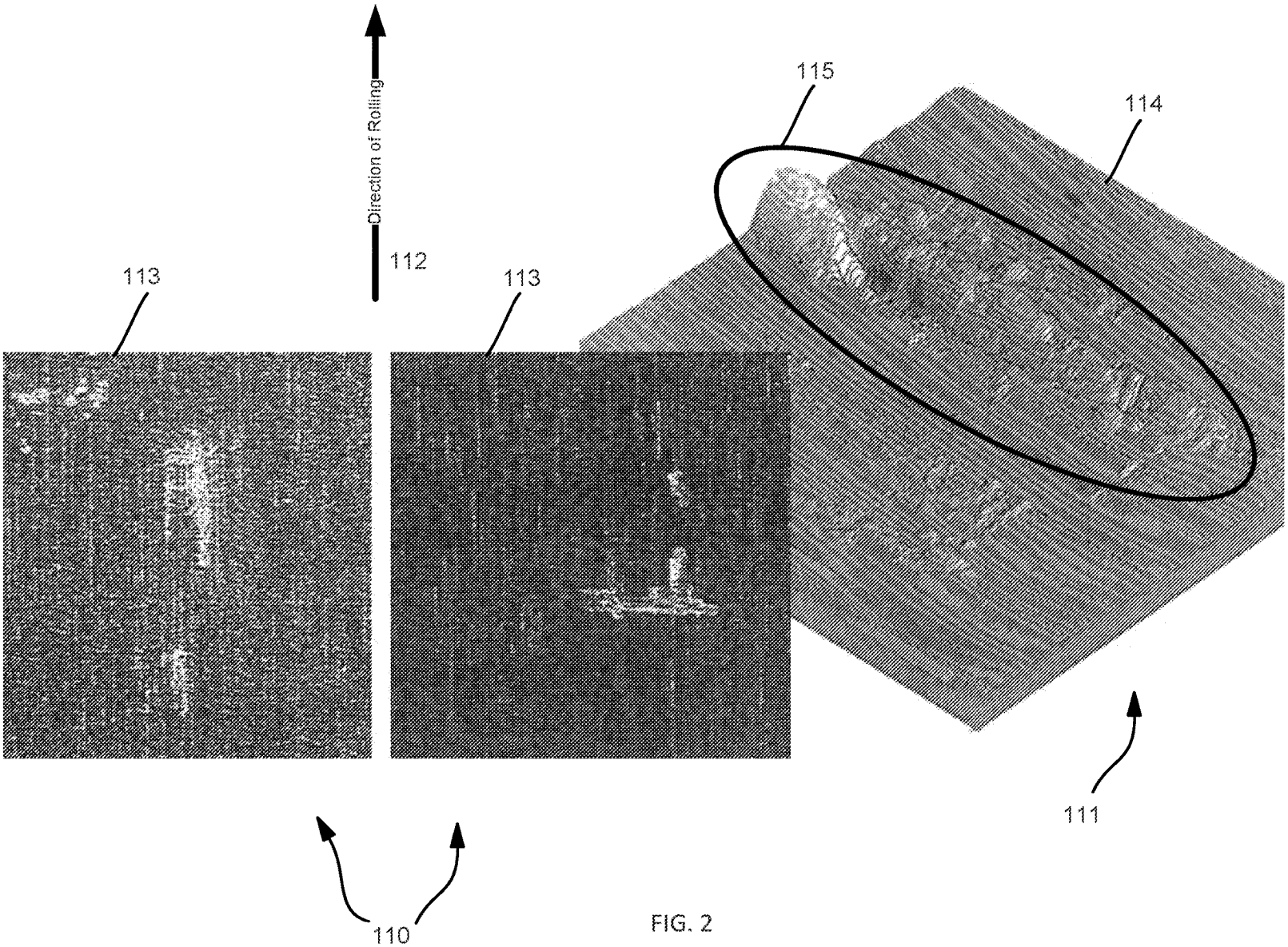
FIG. 2 illustrates pictures of an example scratch-gouge defect of a metal strip.

When coil 101 is rotated and metal strip 102 is moving towards coil 101, air may flow along with the surface of the metal strip as shown in by air flow arrows 108. Therefore, air may become trapped between the metal strip 102 and the coil 101. If air is trapped between the metal strip 102 and the coil 101, or in other words air is trapped between different laps of the metal strip when part of the coil 101, the air may take up space between the laps, and the laps may be prevented from coming together as intended when part of the coil. This space and air between different laps of the metal strip may cause certain negative effects. First, particles may be trapped between the laps of the coil. Second, the laps may move relative to one another since the laps may not be in full contact with each other. Less friction may exist between two laps of coil when the two laps have less contact between each other, i.e, when more air is trapped between them. When a particle (e.g., dirt or dust) is trapped between two laps of coil and the two laps of coil move (e.g., slide or roll) relative to each other, the particle may scratch the strip as it moves, which may be called a "scratch-gouge defect," an example of which is shown in FIG. 2, described below. Other possible negative effects may also take place. For example, rolls such as ironing rolls include a coating that may deform under a load, such as an extra load caused by bounce from the protrusion in the coil. In another example, the cyclic nature of the force from the protrusion may generate excessive heat causing the roll coating to fail. The eccentricity compensated control scheme described herein aims at reducing the impact of the coil's protrusion on the force applied by the roll to the coil's surface.

FIG. 2 illustrates pictures of an example scratch-gouge defect of a metal strip. Images 110 illustrate the scratch-gouge defect as it appears on a strip of metal 113 (which may be similar to, for example, metal strip 102 in FIG. 1). As shown in FIG. 2, the direction of rolling is from the bottom to the top of the images 110. The defect may appear as one or several close scratches in the rolling direction. If multiple scratches in the rolling direction exist, horizontal cross width scratches may also be present that link the rolling direction scratches together.

Image 111 illustrates a 3-D scan of a surface of a scratch gouge defect on a metal strip 114. The indented areas in portion 113 of the strip 114 show the scratch(es) and the raised areas show the cause of the scratch(es) a small particle that has become trapped between laps of the coil. When the laps move relative to each other, the particle may scratch the strip as it slides and rolls. Movement between the laps usually takes place in the rolling direction, but the coil may also experience lateral movement causing sideways scratching instead.

Preventing coil laps from moving relative to one another, and/or preventing air and therefore particles) from being trapped in between the coil laps, may help to prevent the scratch-gauge defect. Both of these problems may be resolved by pressing adjacent laps of a coil against each other so that minimal or no space exists between the laps. For example, the more contact two laps have between each other, the more friction that will exist between the two laps. A roll, such as an ironing roll, may be used to press the newest lap from the incoming metal strip against the lap(s) previous to it, which have already been wound around the coil.

Figure 3:
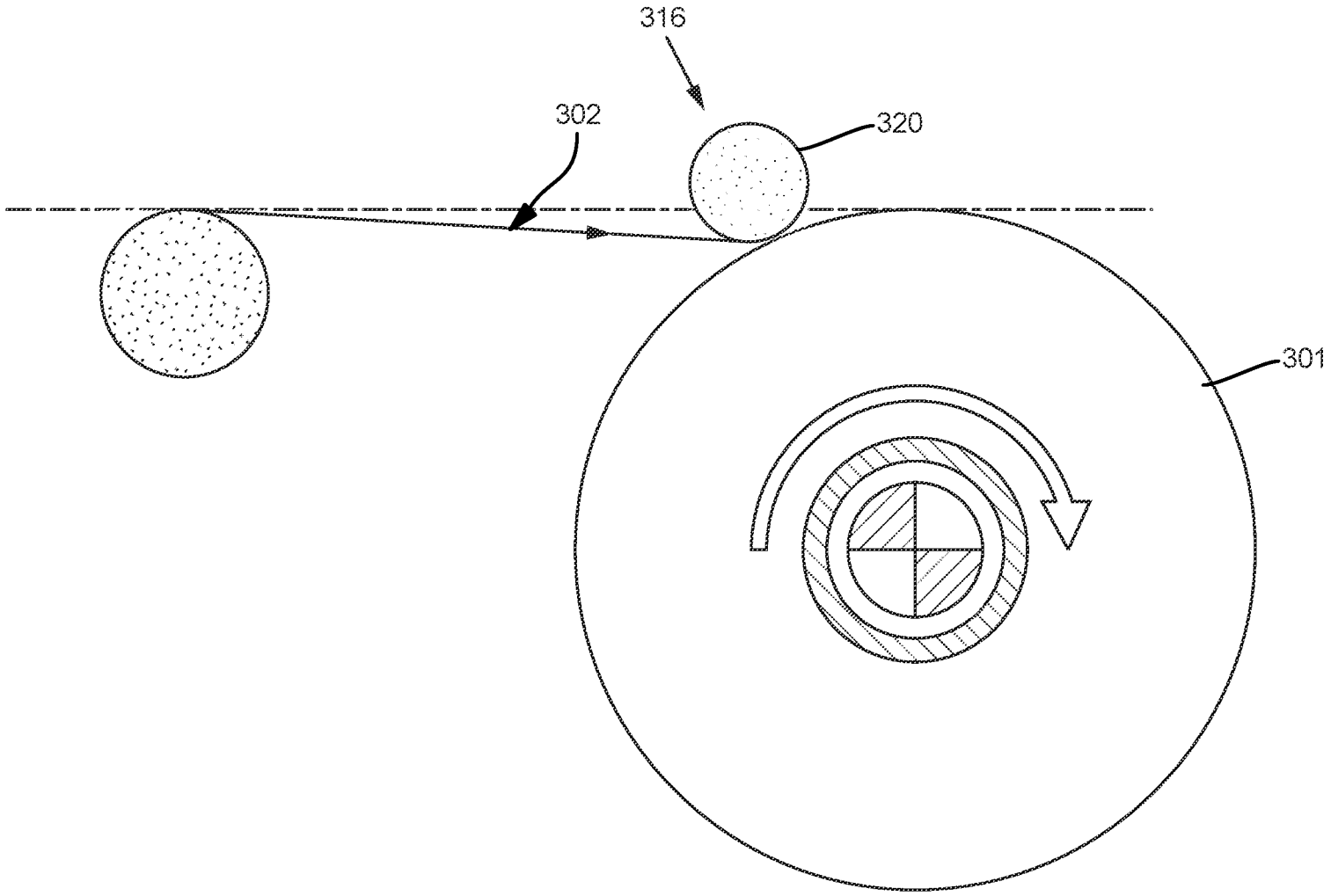
FIG. 3 illustrates a coil formed from a strip of metal with a roll applying a force onto the coil, according to embodiments of the present technology.

FIG. 3 illustrates a coil formed from a strip of metal with a roll applying a force onto the coil, according to embodiments of the present technology. A roll 320, such as an ironing roll, may be in contact with metal strip 302 and/or coil 301 and may apply a force 316 on the metal strip 302 and/or coil 301. The force 316 applied by the roll 320 may cause the metal strip 302 to contact the top lap of coil 301 so as to generate friction between the top lap of coil 301 and the newest lap of coil 301, i.e, metal strip 302. This friction may cause the laps to not move or move minimally with respect to each other, may prevent air from being trapped in between the two laps, and therefore may prevent one or more particles from causing a scratch-gouge defect, or other defects or negative effects.

Roll 320 may be made of, for example, a polymer material to allow the roll to have the compliance it may need during the coiling process. In examples of the present technology, roll 320 may be made of steel, which may allow the roll to have more force to deflect and keep the coil stable. Furthermore, additional coils may be used in conjunction with roll 320; two or more coils may be included in the system, and may be used separately or at the same time.

Figure 4:
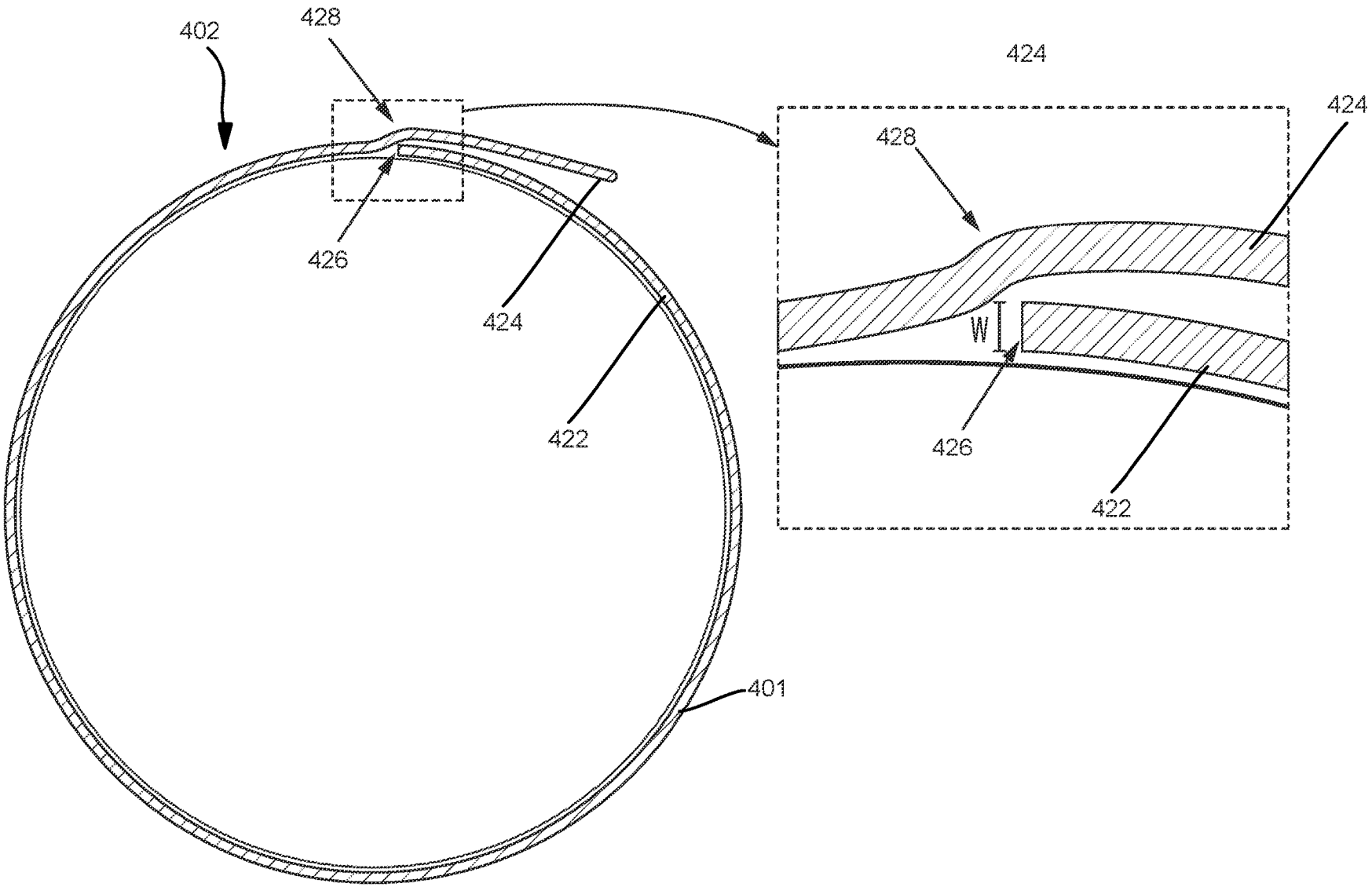
FIG. 4 illustrates a coil formed from a strip of metal and a protrusion in the second lap of the coil, according to embodiments of the present technology.

FIG. 4 illustrates a coil formed from a strip of metal and a protrusion in the second lap of the coil, according to embodiments of the present technology. Coil 402 may include many different "laps" of coil. A lap may be, for example, a portion of the metal strip that reaches around the coil one time. Therefore, each lap of the coil may be of a slightly different length than each other lap of the coil, since the circumference of the coil may be different each time a new lap is added to the coil.

A leading edge 426 of the metal strip may begin a first lap 422 of the coil 402. When a second lap 424 of the coil begins, the second lap 424 of the metal strip may lay on top of the leading edge 426 of the metal strip, causing a bump or protrusion 428 in the metal strip. The protrusion 428 may be caused by the thickness of the leading edge of the coil and the distance between the outer surface of the first lap of the coil and the coiler drum. In other words, the diameter of the coil 402 at the protrusion in the coil may be slightly larger (e.g., by approximately the thickness T of the metal strip) than the diameter of the coil at other parts of the coil. This diameter may gradually start to increase at the beginning of the protrusion, and the maximum diameter of the coil may include the diameter of the coil elsewhere on the coil plus the thickness T of the metal layer. Due to the gradual change in thickness of the protrusion throughout the protrusion itself, the diameter of the coil may gradually change throughout/across the protrusion. The roll may move in an arc so that the roll follows the nip as the coil size increases.

The protrusion 428 may decrease in size as more laps are added to the coil. For example, the protrusion may be at its largest at the second lap of the coil. As more laps of the coil are added to the coil, the protrusion on those laps may become smaller and smaller as compared to protrusions on previous laps of coil.

Figure 5:
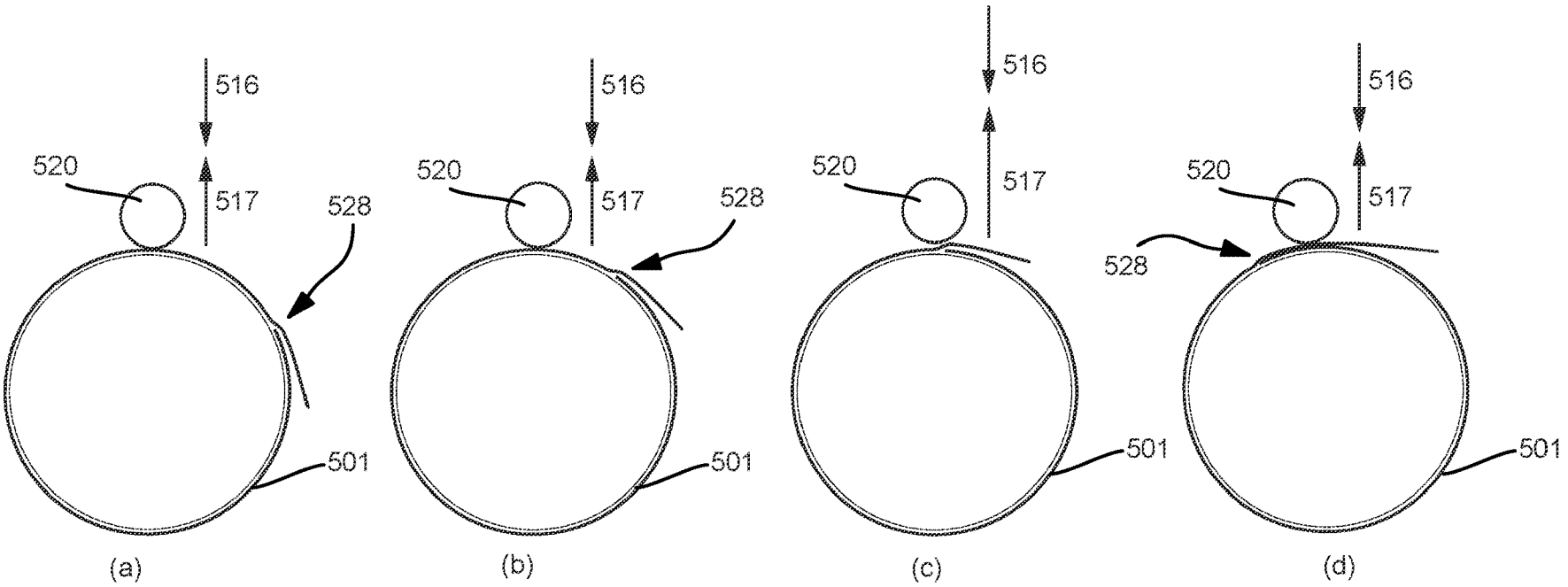
FIG. 5 illustrates a series of coils formed from a strip of metal, a protrusion in the coil, and a roll, according to embodiments of the present technology.

FIG. 5 illustrates a series of coils formed from a strip of metal, a protrusion in the coil, and a roll, according to embodiments of the present technology. As noted with respect to FIG. 4, when a second lap of the a coil (e.g., coil 501) begins, the second lap of the coil may lay on top of the leading edge of the metal strip, causing a protrusion 528 in the metal strip. A roll 520, such as for example an ironing roll, may be used to press the second (or subsequent) lap from the incoming metal strip against the lap(s) previous to it, which have already been wound around the coil. The roll 520 may contact the surface of the coil 501 at the nip of the coil. The coil 501 and roll 520 exert forces on each other, including a radial force 516 from the roll to the coil and a radial force 517 from the coil to the roll. When the protrusion caused by the first lap of coil and the nip are at the same location around the circumference of the coil, the protrusion may cause an increase in the radial force 517' from the coil to the roll, as shown in FIG. 5(*c*). This increased force may be a dynamic or accelerating force caused by the coil, Which may cause a spike in the load of the coil and may damage the metal strip being coiled. This increased force may cause the overall forces between the roll and the coil to become inconsistent. In other words, the protrusion 528 may cause an increase in the force applied to the coil's surface, causing the combined force between the coil 501 and the roll 520 to become unbalanced while the roll is moving across the protrusion 528. Similarly, after the roll 520 moves past the protrusion 528, the radial force 517 from the coil 501 to the roll 520 may decrease again. Therefore, while the forces between the coil 501 and the roll 520 may be constant throughout the majority of the coiling of each lap of coil, the constant force may be interrupted by the protrusion 528. The protrusion may also cause the roll 520 to momentarily and temporarily leave the surface of the metal strip, or "bounce" off the surface of the coil.

A control scheme may use eccentricity compensation to maintain a constant force between the coil 501 and roll 520, even when an eccentric disturbance, such a protrusion in the coil, exists. For example, to compensate for the increased radial force 517' caused by the coil 501, a force 516 from the roll 520, which may be in the opposite direction as the coil force, may be reduced, to keep the combination of forces constant throughout the coiling process. The control scheme may be configured to determine what the reduction in force should be in order to offset the increased coil force from coil 501.

Figure 6:
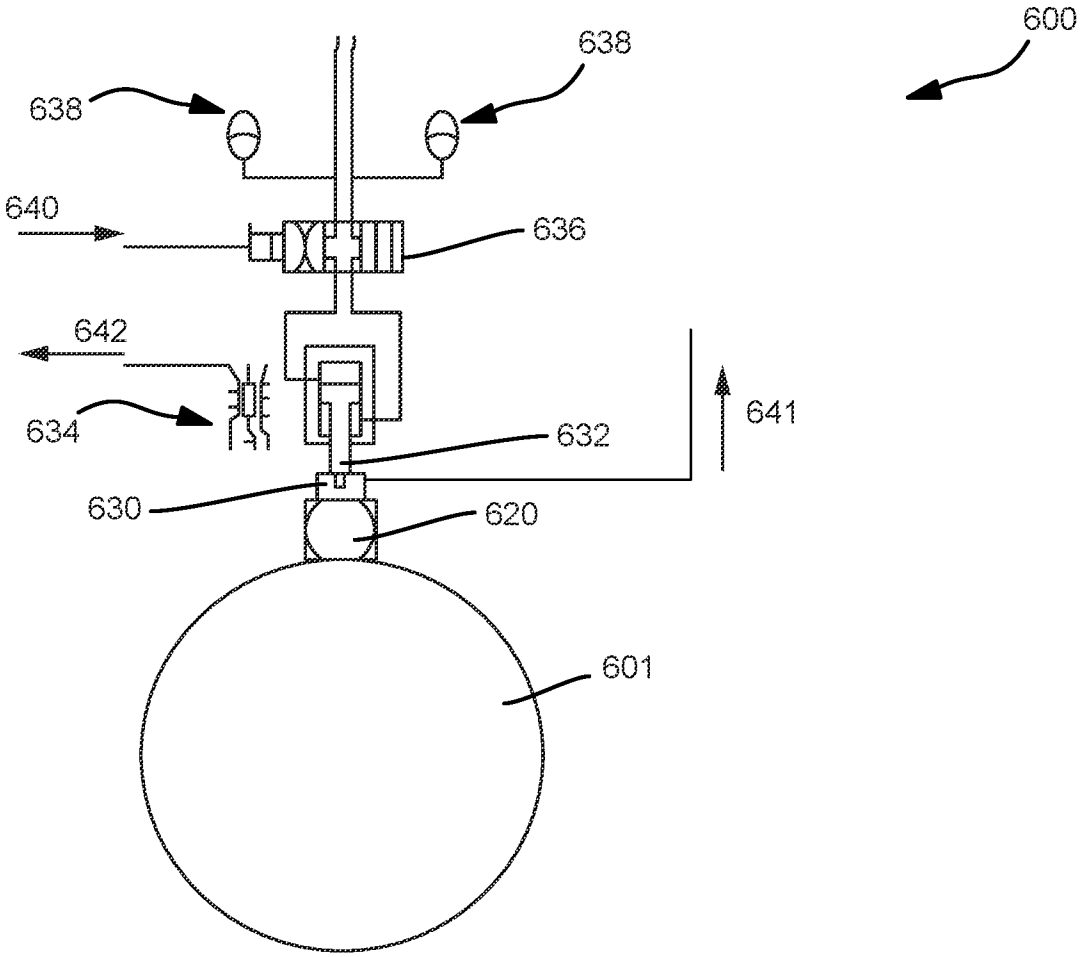
FIG. 6 illustrates a coil with a roll and a hydraulic cylinder system configured to control the roll, according to embodiments of the present technology.

FIG. 6 illustrates a coil with a roll and a hydraulic cylinder system 600 configured to control the roll, according to embodiments of the present technology. As noted herein, a roll 620, such as an ironing roll, may be configured to apply a force onto laps of a coil 601 to prevent air and other debris from being trapped between laps of the coil, and therefore to prevent possible damage to the coil. The force applied by roll 620 may be controlled by a hydraulic cylinder system, as shown in FIG. 6.

The hydraulic cylinder system may include a first sensor, such as force load cell 630, coupled to the roll 620 or to coil 601. Force load cell 630 is a force sensor that, when connected to the roll (or directly to the coil, or to the coil through the roll), can return a signal proportional to the mechanical force applied by the coil 601 to the roll 620, such as the force caused by a protrusion in the coil as described herein protrusion 528). The force load cell 630 may, for example, return a signal proportional to the mechanical force applied by the roll 620, which may be representative of a force applied by the coil 601 to the roll 620. Therefore, in turn, the force load cell captures a signal that represents the amount of force needed to push down on the coil to offset the upward force of the coil to maintain a constant force between the roll 620 and the coil 601. The signal (e.g., signal 641), which may represent the force applied by the coil 601 to the roll 620, may be transmitted to another device or set of devices, such as a circuit, for further processing.

The hydraulic cylinder system may also include a hydraulic cylinder 632. Hydraulic cylinder 632 may be coupled to roll 620, either directly or through force load cell 630, and may control the position of the roll. Therefore, for example, when coil 601 applies an increased force (such as force 517') onto roll 620, such as due to a protrusion in coil 601, hydraulic cylinder 632 may be configured to pull roll 620 away from coil 601 so as to counteract the increased force applied by coil 601. As shown in FIG. 6 and as further explored in more detail in FIG. 7, hydraulic cylinder 632 may be electrically connected to other components, such as a circuit, which may transmit to hydraulic cylinder 632 a signal that represents an adjusted force to be applied by roll 620 as controlled by hydraulic cylinder 632.

The hydraulic cylinder system may also include a servo valve 636. Servo valve 636 is an electrically operated valve that controls how and how much hydraulic fluid is sent to hydraulic cylinder 632. In other words, servo valve 636 may be configured to control the hydraulic cylinder 632 using, for example, a small electrical signal. Servo valve 636 may be configured to receive a signal 640 from another device or set of devices, such as a circuit (e.g., the circuit described further in FIG. 7), which may represent the force that should be applied by roll 620 as controlled by hydraulic cylinder 632.

The hydraulic cylinder system may also include a second sensor, such as linear transducer 634. Linear transducer 634 may be a position sensor configured to convert linear motion from, for example, hydraulic cylinder 632 or roll 620, into an electrical signal. For example, linear transducer 634 may capture a position of the roll 620 or coil 601 and convert that information to signal 642, which may be then sent to another device or set of devices, such as a circuit (e.g., the circuit described further in FIG. 7), to use the signal to perform other operations. As an example, signal 642 may be used as part of a control scheme to determine a force to be applied to roll 620 to offset the increased force of coil 601, as described herein.

The hydraulic cylinder system may also include one or more accumulators 638. In some embodiments, because they are mounted in close proximity to the valve/cylinder, accumulator 638 provides an immediate source of hydraulic pressure. Without accumulators, the internal friction of the pipe connecting the hydraulic pump to the valve may limit the speed of the hydraulic actuator. The accumulator may charge during the period when the bump is not preset and discharge into the system to maintain the pressure during the bump's disturbance. Regarding the return line accumulator, the accumulator may act as a sink for the discharged fluid thereby preventing a return line pressure increase created by pipe friction.

Figure 7:
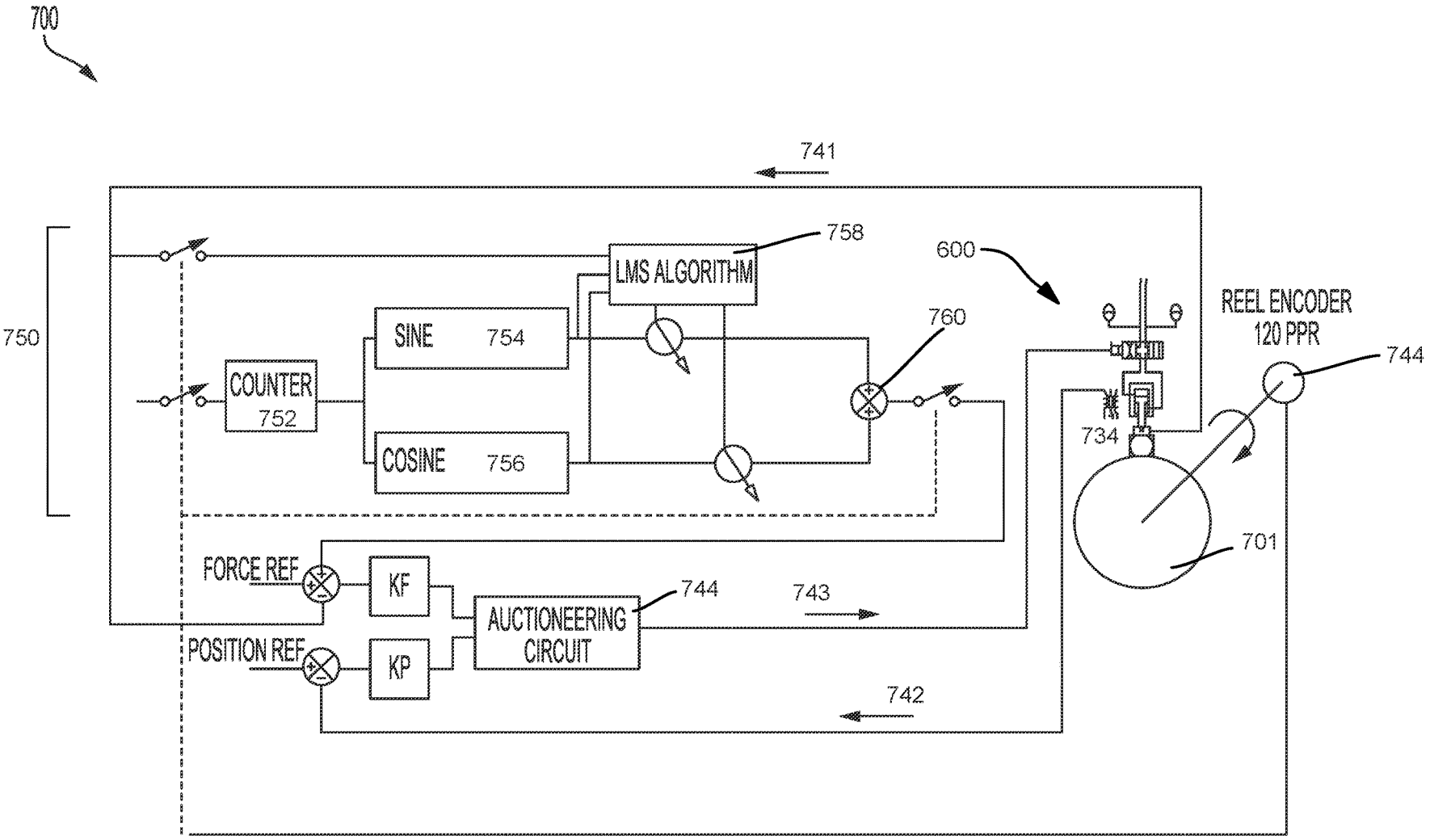
FIG. 7 illustrates an example control system for maintaining a constant force throughout a coiling process, according to embodiments of the present technology.
Figure 8:
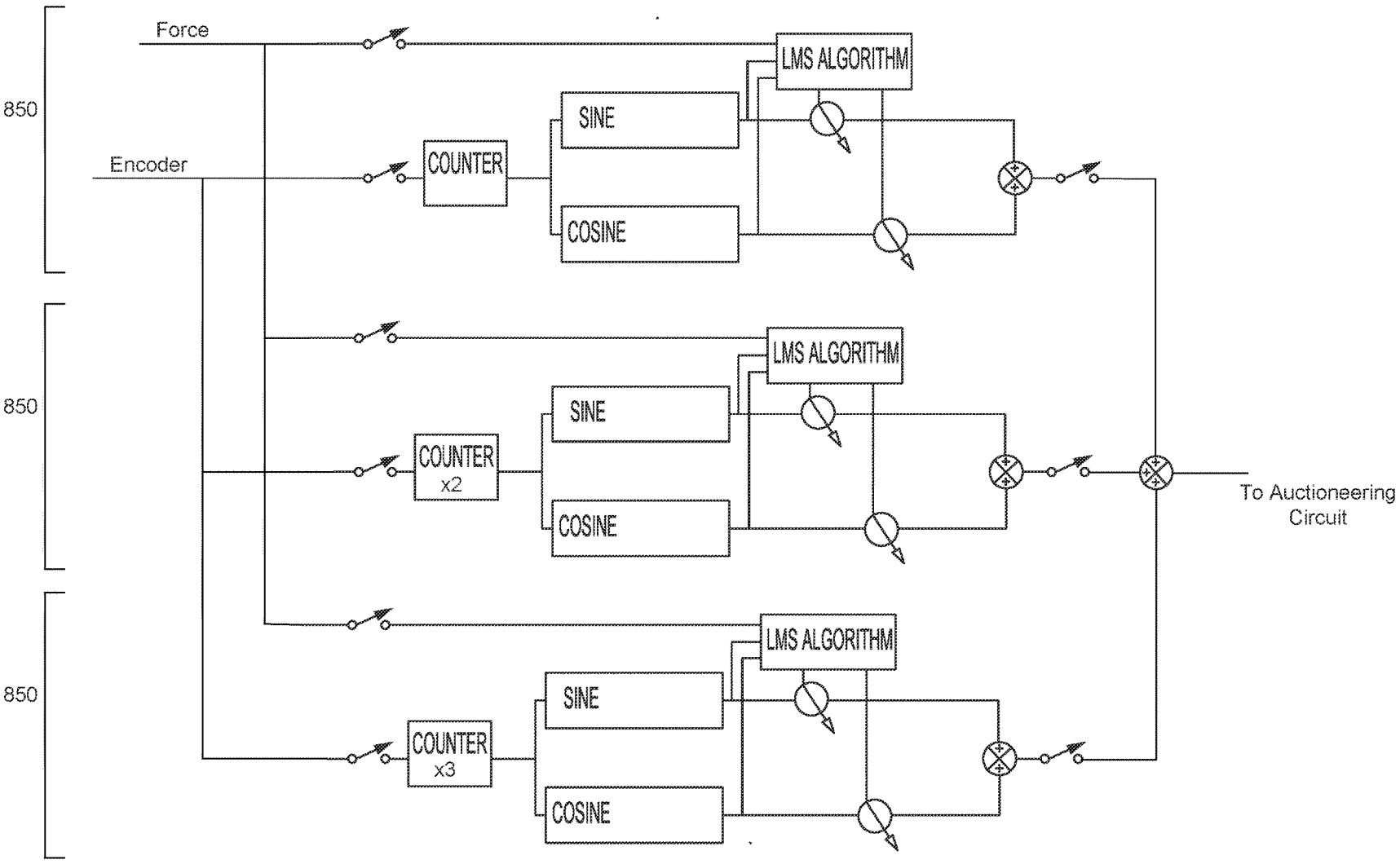
FIG. 8 illustrates an example series of filters used as part of the control system illustrated in FIG. 7, according to embodiments of the present technology.

FIG. 7 illustrates an example control system 700 for maintaining a constant force throughout a coiling process, according to embodiments of the present technology. As shown in FIG. 7, the coil, roll and a hydraulic cylinder system 600 from FIG. 6 makes up a part of the control system 700 in FIG. 7. The control system 700 may be configured to predict the location of the protrusion in a controlled manner. For example, control system 700 may be configured to determine the timing of when the protrusion may come into contact with the roll. The control system 700 may also be configured to determine the force caused by the coil 701 when the protrusion comes into contact with the roll. Determining these two characteristics of the rolling system may allow for the system to offset the upward force of the coil by adjusting the downward force of the roll at the particular time during which the roll comes into contact with the protrusion of the coil.

When a roll, which is in contact with a coil during a coiling process, moves across a protrusion in the coil, as described in more detail with respect to FIGS. 4 and 5, the force load cell connected to the roll may detect an increased force on the roll as caused by the protrusion in the coil. After the roll moves past the protrusion in the coil, the force load cell may detect a decrease in the force back to its original force. To offset this temporary increase in force, the roll may be configured to apply a temporarily decreased force back against the coil when the roll moves across the protrusion, and re-increase the counter force by the roll once it has moved past the protrusion in the coil. In this way, the system may be configured to adjust the roll so that the combination of the downward force of the roll and the upward force of the coil is consistent or constant throughout the coiling process, i.e. during when the roll is in contact with the protrusion and when it is not in contact with the protrusion.

The force load sensor and the linear transducer may collect data from the roll. The data may be representative of forces received at the roll as applied by the coil (e.g., captured by the force load sensor) and the position of the roll (e.g., captured by the linear transducer). Therefore, data may be continuously captured that represents the force applied by the coil when the protrusion is in contact with the roll, and when the protrusion is not in contact with the roll, as well as the position of the roll and the coil with respect to each other. For example, the force load sensor and linear transducer may collect such data during the first laps (e.g., 2 laps, 3, laps, or 4 laps, etc.) of the coiling process. Once the force and position data associated with the roll and coil have been captured, the devices may convert this data into signals and transmit them to the rest of the feedback control loop. For example, the linear transducer may capture the position data and convert it to a position signal 742, which it may then transmit the signal to the position portion of the feedback control loop. Also, the force load sensor may capture the force data and convert it to a force signal 741, which it may then transmit to the force portion of the feedback control loop. The circuit may also include an auctioneering circuit 744, which may choose between the processed position signal ("KP" in FIG. 7) and the force signal ("KF" in FIG. 7), and transmit one to the servo valve. In some embodiments, the servo-valve/hydraulic cylinder actuator may control either the force applied by the actuator or the position of the actuator. In some embodiments, the actuator may not be able to control both at the same time. Auctioneering circuit 744 may allow the actuator to satisfy the need of either the force or position controller depending on the configuration of the auctioneering circuit. In some embodiments, the auctioneering circuit 744 selects the minimum of the two actuator references. For example, as the ironing roll assembly moves the ironing roll into contact with the coil, the actuator's position reference is set to 50% of the stroke while the force reference is set at 1000 Newtons. Since the roll is not in contact with the coil, the force controller's output tries to extend the cylinder by demanding maximum pressure. The position controller requires less pressure to hold the cylinders at a contact stroke. The auctioneering circuit 744 chooses the lesser of the two of position and force. When the ironing roll contacts the coil, the position reference is switched to 100% stroke thereby, in some embodiments, requiring 100% pressure. The force controller may need only 25% pressure and selected by the circuit.

Position and force data associated with the coil and roll may be continuously captured and monitored, and then fed back into the circuit. In other words, the process is continuous as the coil rotates, and the encoder pulse generates an update to the model. The servo-valve/cylinder actuator is governed by two distinct controllers—position and force. In the auctioneering circuit 744, KP represents the position controller and KF represents the force controller. In some embodiments, only one controls the actuator at any given time depending on its demand (e.g., output). Because it is a feedback loop, the force controller may not have the capability to compensate for the bump's disturbance.

While the process of collecting and correlating data as described is performed on a continuous basis, it may also be performed on a wrap-by-wrap basis (e.g., collect force and angular position data over the course of a revolution, do something and then repeat).

Although the various circuit components are shown in FIG. 7 as being connected by lines with portions of the hydraulic cylinder system, portions of the circuitry and/or the hydraulic cylinder system may be located remotely from the coil, roll, hydraulic cylinder, linear transducer, servo valve, etc. For example, a processor may be located remotely from the coiling system and process data or signals received from, for example, a linear transducer 734, which may have previously captured the data or signals from the coiling system e.g., from the hydraulic cylinder).

Control system 700 may include, in addition to the components of the hydraulic cylinder system described in FIG. 6, a reel encoder 746. Reel encoder 744 may be configured to determine the frequency of the coil 701, which may be used as described below with respect to the force prediction circuits 750. A goal of the control strategy is to generate a set of force references, which when summed together produce an actuator force that is opposite in polarity and equal or substantially equal in amplitude to the bump's disturbance. In some embodiments, the controller correlates the force applied by the ironing roll to the coil's surface with the angular position of the coil. The encoder may then produce a signal that corresponds to the angular position of the coil. Control system 700 may also include a counter 752. Counter 752 may, for example, be set at 120 pulses per revolution, and therefore may count from zero to 119 repeatedly. Counter 752 may correlate the position of the coil with the sinusoidal and cosinusoidal components from the force prediction circuits 750, as described in more detail below. In other words, counter 752 may indicate what portion of the coil is being represented. For example, in embodiments, assume that the encoder produces a continuous train of pulses at a rate of 120 pulses per revolution. Each time the counter accumulates 120 pulses from the encoder, it resets to zero. Each count of the counter then represents 3 degrees of rotation. The counters output feeds both a sinusoidal and co-sinusoidal generator such that the frequency of the sine and cosine match the frequency of the coil's rotation. If the counter counts twice for each encoder pulse, the frequency of the sine and cosine signals would be twice the coil's frequency and so on. Correlation of the measured force to the coil's angular position takes place as each encoder pulse is counted. The encoder/counter combination may be replaced with any device or combination of devices that produce a signal corresponding to the angular position of the coil.

As mentioned above, the control system 700 may also include the one or more force prediction circuits 750, each of which may include a counter 752, a sine function engine 754, a cosine function engine 756, and a least mean squares (LMS) algorithm 758. In order to model a reduced force of the roll that can be used to counter the force of the coil as caused by the coil's protrusion as represented by the sine wave(s) from the force prediction circuits 750, the frequency, amplitude, and phase shift of the sine wave(s) at each harmonic may be determined. Reel encoder 744 may be used to measure and determine the frequency. For each force prediction circuit 750, to determine the amplitude and phase shift, a correlation control scheme (e.g., the LMS algorithm 758) may be used. Using the LMS algorithm 758, force feedback from the load transducer may be correlated to sine wave 754 and cosine wave 756. At adder 760, the outputs of the sine wave 754 and cosine wave 756 may be added, and the output of the adder includes a signal that represents a force with a frequency, amplitude, and phase shift that represents the force of the coil as caused by the protrusion in the coil.

An example force prediction circuit 750 may be, for example, a self-tuning bandpass filter with these example components. Although control system 700 in FIG. 7 is only shown to include one force prediction circuit 750, as explained further below, the control system 700 may include any other number of force prediction circuits 750.

As described herein, the hydraulic cylinder may be configured to cause the roll to generate a reduced force that is opposite in polarity to the force generated by the coil, caused by the protrusion in the coil, and that is sufficient to maintain a consistent combination of forces between the roll and the coil throughout the coiling process. The control system 700 may be configured to generate a signal that represents the accurately calculated opposite force for the hydraulic cylinder (e.g., via the servo valve) to use to generate the roll force. In other words, this active system may provide energy necessary to move the ironing roll radially with respect to the coil, a precise amount. In order to determine which force the roll should have, the force of the protrusion may be determined and modeled. The protrusion in the coil may be modeled as one or more harmonics (i.e. a component frequency of a sinusoidal wave). Each component frequency may represent a frequency/angular speed at which the coil is spinning/rotating. The number of frequencies, and therefore force prediction circuits, that are needed for a given modeling may be determined adaptively based on the situation. For example, in some embodiments, the servo-valve/cylinder actuator has a frequency limit. Let's assume the limit is found to be 45 Hertz. As the coiling operation begins, the angular frequency of the coil is at its maximum but as the coil builds to a larger diameter, the frequency decreases. If the coil's maximum frequency is 15 Hertz, only the first three harmonic filters are used. If the fourth were used, the required actuator frequency would be 60 Hertz. As the coil slows down, additional harmonics can be applied as their frequency falls below 50 hertz. Each of the five harmonics would be represented by a separate force prediction circuit 750, which could be connected to one another as shown in FIG. S (which shows three example force prediction circuits 850, which represent three different harmonics).

Ideally, to achieve a perfect model of the protrusion, the protrusion may be modeled as a set that includes an infinite number of harmonics. However, even representing the model as a set of more than one harmonic, such as two, three, four, five, six, or more harmonics, may provide a relatively accurate model for the protrusion (for example, generating a model using five harmonics may provide approximately 90% of the accuracy of a model that may theoretically use an infinite number of harmonics). For an example, the model may be generated using five harmonics. Of the five harmonics, one harmonic would represent the fundamental frequency (e.g., N Hz), and the remaining four harmonics would be multiples of the fundamental frequency (2×N Hz, 3×N Hz, 4×N Hz, 5×N Hz, etc.). The fundamental, and therefore all five frequencies, may change frequently since the speed of the coil may change frequently; the harmonics used always represent the current speed of the coil at a given time. Since the algorithm described herein is event based, not time based (e.g., pulses from the encoder generate the actual code execution), changes in mill speed may not impact performance.

Feedback control systems may inherently include a phase delay. The output of the controller may be out of synth with the coil's angular position, hence the need for a feedforward control component. For example, in some embodiments, the control signal is based on a model versus feedback while the model itself is based on feedback. Although the system relies on feedback to tune the model, the system may generate an ironing roll force reference in anticipation of changes in the coil's radius, as described herein.

Figure 9:
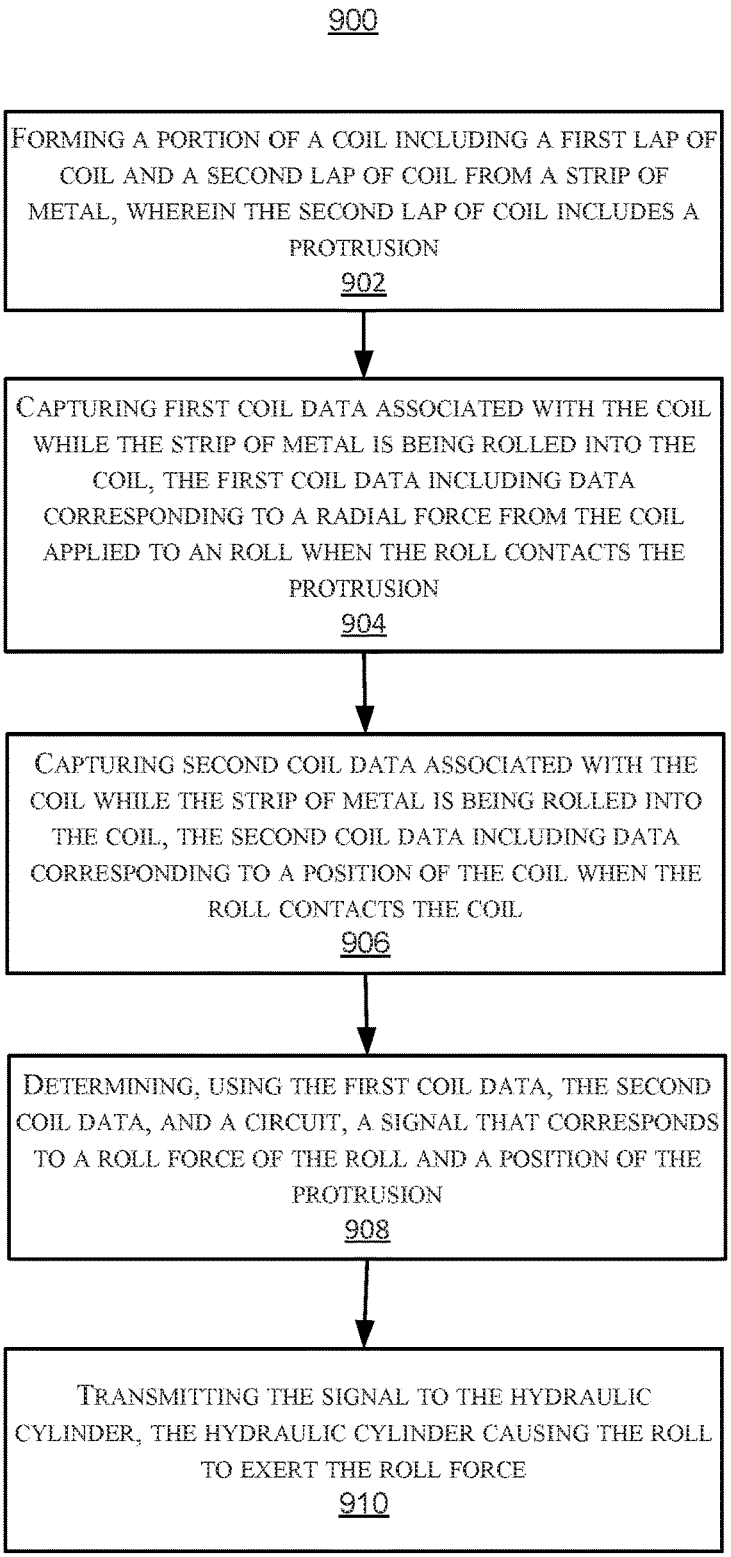
FIG. 9 is an example flow diagram of an example process, according to embodiments of the present technology.

FIG. 9 is an example flow diagram of an example process according to embodiments of the present technology. Step 902 may include, for example, forming, by a coil forming operation using a coiling apparatus, a portion of a coil including a first lap of coil and a second lap of coil from a strip of metal, wherein the second lap of coil includes a protrusion. The protrusion or bump may be caused by a leading edge of the first lap of the coil and the second lap of coil overlapping the leading edge. The protrusion may be caused by the fact that the leading edge of the first lap has a non-zero height/thickness.

Step 904 may include, for example, capturing, by a first sensor during the coil forming operation, first coil data associated with the coil while the strip of metal is being rolled into the coil, wherein the first coil data includes data corresponding to a radial force from the coil applied to a roll when the roll contacts the protrusion. The first sensor may include a force load cell or other device configured to detect a force of the coil and transfer that data into a signal. The first coil data may include data corresponding to the coil force, caused by, for example, the protrusion and the roll contacting the protrusion. Step 906 may include, for example, capturing, by a second sensor during the coil forming operation, second coil data associated with the coil while the strip of metal is being rolled into the coil, wherein the second coil data includes data corresponding to a position of the coil when the roll contacts the coil. The second sensor may include a linear transducer or other device configured to detect a position of the coil and transfer that data into a signal. The second coil data may include data corresponding to the coil position. The coil position may include various specific data about the position of the coil at a specific time. In one example, coil position data may include the diameter of the coil surface e.g., height of protrusion) under the roll at a specific time during the coil forming operation.

Step 908 may include, for example, determining, using the first coil data, the second coil data, and a circuit, a signal that corresponds to a roll force of the roll and a position of the protrusion. The circuit may be made up of one or more self-tuning bandpass filters. Each bandpass filter may be associated with a different harmonic of the coil speed, and the combination of filters may be used in combination to output a signal that represents a force of the roll that is opposite to the force of the coil so the combination of forces between the roll and the coil remains consistent throughout the coiling process. Step 910 may include, for example, transmitting, to a hydraulic cylinder coupled to the roll, the signal, wherein after the signal is received by the hydraulic cylinder, the hydraulic cylinder causes the roll to exert the roll force, wherein the roll force is counter to the radial force of the coil. After the opposite force is determined, a signal representing that opposite force may be applied to the roll by the hydraulic cylinder, causing a substantially constant force to be achieved throughout the coiling process.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

The use of the terms "a" and "an" and "the" and similar referents in the context of describing the invention (especially in the context of the following claims) are to be construed to cover both the singular and the plural, unless otherwise indicated herein or clearly contradicted by context The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

A collection of exemplary examples, including at least some explicitly enumerated as "ECs" (Example Combinations), providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

EC 1. A method, the method comprising: forming, by a coil forming operation using a coiling apparatus, a portion of a coil including a first lap of coil and a second lap of coil from a strip of metal, wherein the second lap of coil includes a protrusion; capturing, by a first sensor during the coil forming operation, first coil data associated with the coil while the strip of metal is being rolled into the coil, wherein the first coil data includes data corresponding to a radial force from the coil applied to a roll when the roll contacts the protrusion; capturing, by a second sensor during the coil forming operation, second coil data associated with the coil while the strip of metal is being rolled into the coil, wherein the second coil data includes data corresponding to a position of the coil when the roll contacts the coil; determining, using the first coil data, the second coil data, and a circuit, a signal that corresponds to a roll force of the roll and a position of the protrusion; and transmitting, to a hydraulic cylinder coupled to the roll, the signal, wherein after the signal is received by the hydraulic cylinder, the hydraulic cylinder causes the roll to exert the roll force, wherein the roll force is counter to the radial force of the coil.

EC 2. The method of any of the preceding or subsequent example combinations, wherein the hydraulic cylinder causing the roll to exert the roll force includes reducing the force exerted by the roll.

EC 3. The method of any of the preceding or subsequent example combinations, further comprising determining, using a reel encoder electrically connected to the coil, data corresponding to frequencies of the coil over a period of time.

EC 4. The method of any of the preceding or subsequent example combinations, wherein the circuit includes a set of self-tuning bandpass filters.

EC 5. The method of any of the preceding or subsequent example combinations, wherein each filter of the set of self-tuning bandpass filters is associated with a harmonic of an angular speed of the coil.

EC 6. The method of any of the preceding or subsequent example combinations, wherein the protrusion in the second lap of the coil is formed at least in part by a leading edge of the first lap of coil.

EC 7. The method of any of the preceding or subsequent example combinations, wherein the second coil data includes data corresponding to a position of the coil when the roll contacts the protrusion.

EC 8. The method of any of the preceding or subsequent example combinations, wherein the first sensor is a force load cell electrically connected to the roll.

EC 9. The method of any of the preceding or subsequent example combinations, wherein the second sensor is a linear transducer electrically connected to the hydraulic cylinder.

EC 10. The method of any of the preceding or subsequent example combinations, wherein the roll is an ironing roll.

EC 11. A system, comprising: a roll configured to contact a surface of a coil, wherein the coil is formed by a coil forming operation using a coiling apparatus; a force load cell configured to capture first data corresponding to a first force delivered by the coil in one direction; a linear transducer configured to capture second data corresponding to a position of the coil; a circuit configured to determine, using the first data and the second data, a signal associated with a second force to counteract the first force; and a hydraulic cylinder configured to receive the signal from the circuit and deliver the second force to the roll in a second direction opposite the first direction.

EC 12. The system of any of the preceding or subsequent example combinations, Wherein the hydraulic cylinder causing the roll to exert the roll force includes reducing the force exerted by the roll.

EC 13. The system of any of the preceding or subsequent example combinations, further comprising a reel encoder electrically connected to the coil, wherein the reel encoder is configured to generate data corresponding to frequencies of the coil over a period of time.

EC 14. The system of any of the preceding or subsequent example combinations, Wherein the circuit includes a set of self-tuning bandpass filters.

EC 15. The system of any of the preceding or subsequent example combinations, Wherein each filter of the set of self-tuning bandpass filters is associated with a harmonic of an angular speed of the coil.

EC 16. The system of any of the preceding or subsequent example combinations, wherein a portion of the coil includes a first lap of coil and a second lap of coil from a strip of metal, wherein the second lap of coil includes a protrusion, wherein the protrusion in the second lap of the coil is formed at least in part by a leading edge of the first lap of coil.

EC 17. The system of any of the preceding or subsequent example combinations, wherein the second coil data includes data corresponding to a position of the coil when the roll contacts the protrusion.

EC 18. The system of any of the preceding or subsequent example combinations, Wherein the force load cell is electrically connected to the roll.

EC 19. The system of any of the preceding or subsequent example combinations, Wherein the linear transducer is electrically connected to the hydraulic cylinder.

EC 20. The system of any of the preceding or subsequent example combinations, further comprising the roll is an ironing roll.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein, That which is claimed is:

1. A method, comprising:

forming, by a coil forming operation using a coiling apparatus, a portion of a coil including a first lap of coil and a second lap of coil from a strip of metal, wherein the second lap of coil includes a protrusion;

capturing, by a first sensor during the coil forming operation, first coil data associated with the coil while the strip of metal is being rolled into the coil, wherein the first coil data includes data corresponding to a radial force from the coil applied to a roll when the roll contacts the protrusion;

capturing, by a second sensor during the coil forming operation, second coil data associated with the coil while the strip of metal is being rolled into the coil, wherein the second coil data includes data corresponding to a position of the coil when the roll contacts the coil;

determining, using the first coil data, the second coil data, and a circuit, a signal that corresponds to a roll force of the roll and a position of the protrusion; and transmitting, to a hydraulic cylinder coupled to the roll, the signal, wherein after the signal is received by the hydraulic cylinder, the hydraulic cylinder causes the roll to exert the roll force, wherein the roll force is counter to the radial force of the coil, wherein the circuit includes a set of self-tuning bandpass filters, and wherein each filter of the set of self-tuning bandpass filters is associated with a harmonic of an angular speed of the coil.

2. The method of claim 1, wherein the hydraulic cylinder causing the roll to exert the roll force includes reducing the force exerted by the roll.

3. The method of claim 1, further comprising:

determining, using a reel encoder electrically connected to the coil, data corresponding to frequencies of the coil over a period of time.

4. The method of claim 1, wherein the protrusion in the second lap of the coil is formed at least in part by a leading edge of the first lap of coil.

5. The method of claim 1, wherein the second coil data includes data corresponding to a position of the coil when the roll contacts the protrusion.

6. The method of claim 1, wherein the first sensor is a force load cell electrically connected to the roll.

7. The method of claim 1, wherein the second sensor is a linear transducer electrically connected to the hydraulic cylinder.

8. The method of claim 1, wherein the roll is an ironing roll.

9. A system, comprising:

a roll configured to contact a surface of a coil, wherein the coil is formed by a coil forming operation using a coiling apparatus;

a first sensor configured to capture first data corresponding to a first force delivered by the coil in a first direction;

a second sensor configured to capture second data corresponding to a position of the coil;

a circuit configured to determine, using the first data and the second data, a signal associated with a second force to counteract the first force; and a hydraulic cylinder configured to receive the signal from the circuit and deliver the second force to the roll in a second direction opposite the first direction, wherein the circuit includes a set of self-tuning bandpass filters, and wherein each filter of the set of self-tuning bandpass filters is associated with a harmonic of an angular speed of the coil.

10. The system of claim 9, wherein the hydraulic cylinder causing the roll to exert the roll force includes reducing the force exerted by the roll.

11. The system of claim 9, further comprising a reel encoder electrically connected to the coil, wherein the reel encoder is configured to generate data corresponding to frequencies of the coil over a period of time.

12. The system of claim 9, wherein a portion of the coil includes a first lap of coil and a second lap of coil from a strip of metal, wherein the second lap of coil includes a protrusion, wherein the protrusion in the second lap of the coil is formed at least in part by a leading edge of the first lap of coil.

13. The system of claim 12, wherein the second coil data includes data corresponding to a position of the coil when the roll contacts the protrusion.

14. The system of claim 9, wherein the force load cell is electrically connected to the roll.

15. The system of claim 9, wherein the linear transducer is electrically connected to the hydraulic cylinder.

16. The system of claim 9, wherein the roll is an ironing roll.

* * * * *